US006530222B2

(12) United States Patent
Stuttaford et al.

(10) Patent No.: US 6,530,222 B2
(45) Date of Patent: Mar. 11, 2003

(54) SWIRLED DIFFUSION DUMP COMBUSTOR

(75) Inventors: Peter Stuttaford, Toronto (CA); Aleksandar Kojovic, Oakville (CA)

(73) Assignee: Pratt & Whitney Canada Corp., Quebec Corp. (CA)

( * ) Notice: Subject to any disclaimer, the term of this patent is extended or adjusted under 35 U.S.C. 154(b) by 0 days.

(21) Appl. No.: 09/903,638

(22) Filed: Jul. 13, 2001

(65) Prior Publication Data

US 2003/0010032 A1 Jan. 16, 2003

(51) Int. Cl.[7] ..... F02C 1/00
(52) U.S. Cl. ..... 60/737; 60/746; 60/748
(58) Field of Search ..... 60/39.821, 737, 60/746, 748

(56) References Cited

U.S. PATENT DOCUMENTS

| | | | | |
|---|---|---|---|---|
| 3,917,173 A | * | 11/1975 | Singh | 239/400 |
| 4,198,815 A | | 4/1980 | Bobo et al. | |
| 4,292,801 A | | 10/1981 | Wilkes et al. | 60/39.06 |
| 5,069,029 A | | 12/1991 | Kuroda et al. | 60/733 |
| 5,121,597 A | | 6/1992 | Urushidani et al. | 60/733 |
| 5,359,847 A | | 11/1994 | Pillsbury et al. | 60/737 |
| 5,381,652 A | | 1/1995 | Mezzedimi et al. | 60/737 |
| 5,452,574 A | | 9/1995 | Cowell et al. | 60/723 |
| 5,511,375 A | * | 4/1996 | Joshi et al. | 60/737 |
| 5,660,045 A | | 8/1997 | Ito et al. | 60/737 |
| 5,685,157 A | * | 11/1997 | Pandalia et al. | 60/725 |
| 5,899,074 A | | 5/1999 | Komatsu et al. | 60/737 |
| 5,901,555 A | | 5/1999 | Mandai et al. | 60/747 |
| 6,026,645 A | | 2/2000 | Stokes et al. | 60/737 |
| 6,038,861 A | | 3/2000 | Amos et al. | 60/737 |
| 6,047,551 A | | 4/2000 | Ishiguro et al. | 60/740 |
| 6,070,411 A | | 6/2000 | Iwai et al. | 60/737 |
| 6,082,111 A | | 7/2000 | Stokes | 60/737 |
| 6,109,038 A | | 8/2000 | Sharifi et al. | |
| 6,122,916 A | | 9/2000 | Amos et al. | 60/747 |

FOREIGN PATENT DOCUMENTS

| | | |
|---|---|---|
| EP | 0 957 311 | 11/1999 |
| EP | 0 974 735 | 1/2000 |
| EP | 1 108 957 | 6/2001 |
| EP | 1108957 A1 * | 6/2001 |
| EP | 1 193 450 | 4/2002 |

* cited by examiner

*Primary Examiner*—Charles G. Freay
*Assistant Examiner*—John F Belena
(74) *Attorney, Agent, or Firm*—Bachman & LaPointe, P.C.

(57) ABSTRACT

A swirled diffusion dump combustor of the present invention includes a cylindrical combustor can and a fuel and air mixer attached to the upstream end of the combustor can. The mixer is generally formed by an annular chamber which is defined between annular outer and inner walls, having an annularly continuous truncated conical crass-section. The upstream end of the annular chamber is closed by a manifold ring which includes an annular fuel passage and two rows of swirled air passages. Thus, the compressor air approaching the mixer from above enters the swirled air passages, and the swirled air flow in the annular chamber shears fuel from the lips of the annular fuel passage to produce a fuel/air mixture. The mixture swirl is accelerated in the annular chamber and passes a downstream annular passage which serves as the region of diffusive mixing, and also as a flame flashback restrictor. The flow then dumps into the combustor can, providing the final level of mixing, where it then burns. The burning fuel/air mixture is stabilized by the swirling flow from the swirled air passages, as well as by the pressure gradient induced re-circulation to the upstream end of the combustor can. The front face of the combustor can is cooled by compressor air flowing through a series of effusion holes and the cylindrical side wall of the combustor can is cooled by air flow through an impingement cooling skin.

20 Claims, 3 Drawing Sheets

SWIRLED DIFFUSION DUMP COMBUSTOR

FIELD OF THE INVENTION

The present invention relates to gas turbine engines, particularly to a swirled diffusion dump combustor, and more particularly to a fuel and gas premixer used with a swirled diffusion dump combustor for the type of gas turbines which may be used in power plant applications.

BACKGROUND OF THE INVENTION

Industrial gas turbine engines have increasingly stringent emission requirements. In order to provide a marketable power generation product, an engine producing the lowest possible emissions is crucial. Emissions of nitrogen oxides ($NO_x$) and carbon monoxide (CO) must be minimized over specified engine operating ranges. To achieve this low level of emissions the combustion system requires the complete burning of fuel and air at law temperatures Combustors that achieve low $NO_x$ emissions without water injection are known as dry-low emissions (DLE) and offer the prospect of clean emissions combined with high engine efficiency. This technology relies on a high air content in the fuel/air mixture. Therefore the current technology for achieving low $NO_x$ emissions may require a fuel/air premixer.

In a DLE system, fuel and air are leave-premixed prior to injection into the combustor. No diluent additions, such as water injection are needed to achieve significantly low combustion temperatures, which minimize the amount of $NO_x$ formation. However, two problems have been observed. The first is combustion instability and noise or unstable engine operability and the second relates to CO emissions and decreasing combustion efficiency. The stability of combustion rapidly decreases under lean conditions and the combustor may be operating close to its blow-out limit because of the exponential temperature dependence of the chemical reactions. This can also lead to combustion instabilities which change the dynamic behaviour of the combustion process, and endanger the mechanical integrity of the entire gas turbine engine. This is because several constraints are imposed on the homogeneity of the fuel/air mixture since leaner than average pockets of mixture may lead to stability problems, and richer than average pockets will lead to unacceptably high $NO_x$ emissions. At the same time, a substantial increase in CO and unburned hydrocarbon (UHC) emissions as a tracer for combustion efficiency is observed, which is due to the exponential decrease in chemical reaction kinetics at leaner mixtures, for a given combustor.

It has been found that a key requirement for a successful DLE combustion system is the reaction of a perfectly mixed fuel and air mixture that has a variation not greater than +/−3% in fuel/air ratio at the inlet to the combustor. The flow field generated in the combustor must be stable to ensure complete burning of the fuel and air, while minimizing combustion noise.

Other problems relating to a combustion system in which fuel and air are premixed prior to injection into the combustor are auto-ignition and flame flashback. Premixers used for low emission combustion systems must overcome those problems as well. Efforts have been made to develop improved low emission combustion systems, particularly with fuel/air premixers, examples of which are described in U.S. patent application Ser. No. 09/742,009, entitled DIFFUSION MIXER filed on Dec. 22, 2000 and in U.S. patent application Ser. No. 09/840,991, entitled DIFFUSION COMBUSTOR, filed on Apr. 25, 2001, both assigned to the assignee of this patent application. Nevertheless, there is still a need for improved low emission combustion systems and particularly for improved premixers for such combustion systems,

SUMMARY OF THE INVENTION

It is an object of the present invention to provide a fuel and air mixer which is capable of providing a better fuel/air mixture for a low emission combustor.

It is another object of the present invention to provide a single fuel and air mixer capable of staging the fuel/air mixture supply to meet different requirements of engine operating conditions.

It is a further object of the present invention to provide a swirled diffusion dump combustor used for gas turbine engines to achieve low $NO_x$ and CO emissions from base load to part load engine operating conditions.

In accordance with one aspect of the present invention, there is a mixer provided for a gas turbine combustor. The mixer comprises an annular chamber having an upstream end and a downstream end, and a manifold ring closing the upstream end of the annular chamber. The annular chamber includes an annular inner wall and an annular outer wall to define the chamber therebetween, the annular inner wall extending downstream-wise, radially and outwardly and the annular outer wall extending downstream-wise radially and inwardly. The manifold ring includes a fuel passage in fluid communication with the annular chamber for feeding fuel into the annular chamber, and a plurality swirled air passages to provide swirled compressor air flows into the annular chamber. The swirled air flows mix with fuel from the fuel passages, thereby producing a fuel/air mixture in the annular chamber. A downstream end of the annular chamber is adapted to be connected to the combustor in fluid communication therewith for dumping the fuel/air mixture into the combustor for combustion.

The fuel passage is preferably farmed by a fuel ring coaxial with the annular chamber. The fuel ring preferably includes annular inner and outer walls extending from the manifold ring downstream-wise to define an annular fuel passage with a plurality of holes in a downstream end of the fuel ring. The holes are located in a circumferentially spaced apart relationship. The fuel ring according to one embodiment of the present invention includes two radially positioned buffer plates circumferentially spaced apart from each other to divide the annular passage into two passage sections, permitting fuel delivery through either passage sections or through both sections simultaneously so that local fuel and air mixing ratios can he adjusted without changing the overall fuel and air flow mass.

The swirled air passages preferably include first and second groups of air passages extending through the manifold ring and distributed in a circumferentially spaced apart relationship along respective first and second circular lines coaxial with the first fuel ring. The first circular line has a diameter smaller than the diameter of the fuel ring, and the second circular line has a diameter greater than the diameter of the fuel ring.

The air passages in the respective first and second groups according to one embodiment of the present-invention are tangentially inclined in one rotational direction, either clockwise or counter-clockwise, to produce a spiral air flow is the annular chamber, which results in a relatively stable flame in the combustor. In another embodiment of the present invention, the air passages in one of the first and second groups are tangentially inclined in a clockwise direction while the air passages of the other group are inclined in a counter-clockwise direction to produce air turbulence in the annular chamber of the mixer, which results in a better mixing of fuel and air.

It is preferable to provide a downstream annular passage defined between cylindrical inner and outer walls extending downstream-wise from the downstream end of the annular chamber. The downstream annular passage serves as a region of diffusive mixing and is adapted to be connected to the combustor in fluid communication for dumping the fuel/air mixture from the annular chamber into the combustor for combustion.

In accordance with another aspect of the present invention, a gas turbine combustor is provided. The combustor comprises a cylindrical combustor can for receiving a fuel/air mixture to produce combustion products. The combustor can has a central axis and includes an annular side wall and opposed upstream and downstream ends. At least one igniter is positioned inside the combustor can and is attached to the combustor can. The mixer according to the present invention is attached to the upstream end of a combustor can, in a coaxial relationship. It is preferable that an end plate be attached to an end periphery of the inner wall of the downstream annular passage of the mixer, thereby forming a central portion of an upstream end wall of the combustor can such that an annular opening at the upstream end is formed around the center portion of the upstream end wall thereof. The annular opening does not interfere with the mixture flow passing therethrough so that the dynamic features of the fuel/air mixture obtained from the mixing process in the mixer will not be affected when the fuel/air mixture is dumped into the combustor can for combustion.

The central aperture of the fuel ring which is in fluid communication with a central passage defined within the annular inner wall of the annular chamber, preferably receives a pilot fuel line extending therethrough and connected to the central portion of the upstream end wall of the combustor can for delivering fuel into the combustor can. A pilot flame provides a stabilizing diffusion flame at part load conditions. The central portion of the upstream end wall preferably includes a plurality of holes for admission of air flows from the central aperture and the central, passage to cool the upstream end wall of the combustor can. The mixer according to the present invention is able to provide a fuel/air mixture with a mixing ratio variation of less than +/−3% at the inlet to the combustor. Therefore the swirled diffusion dump combustor according to the present invention advantageously achieves low emissions with $NO_x$ lower than 10 ppm and CO lower than 20 ppm from base load to part load conditions. Furthermore, the structures of the mixer of the present invention effectively prevents auto-ignition and flame flashback. The burning fuel/air mixture in the primary combustion zone of the combustor is stabilized by the swirl generated in the annular chamber of the mixer and by the pressure gradient induced circulation toward the upstream end wall of the combustor can.

Other advantages and features of the present invention will be better understood with reference to preferred embodiments of the present invention described hereinafter.

BRIEF DESCRIPTION OF THE DRAWINGS

Having thus generally described the nature of the present invention, reference will now be made to the accompanying drawings, by way of examples, showing preferred embodiments, in which.

DETAILED DESCRIPTION OF THE PREFERRED EMBODIMENT

Figure 1:
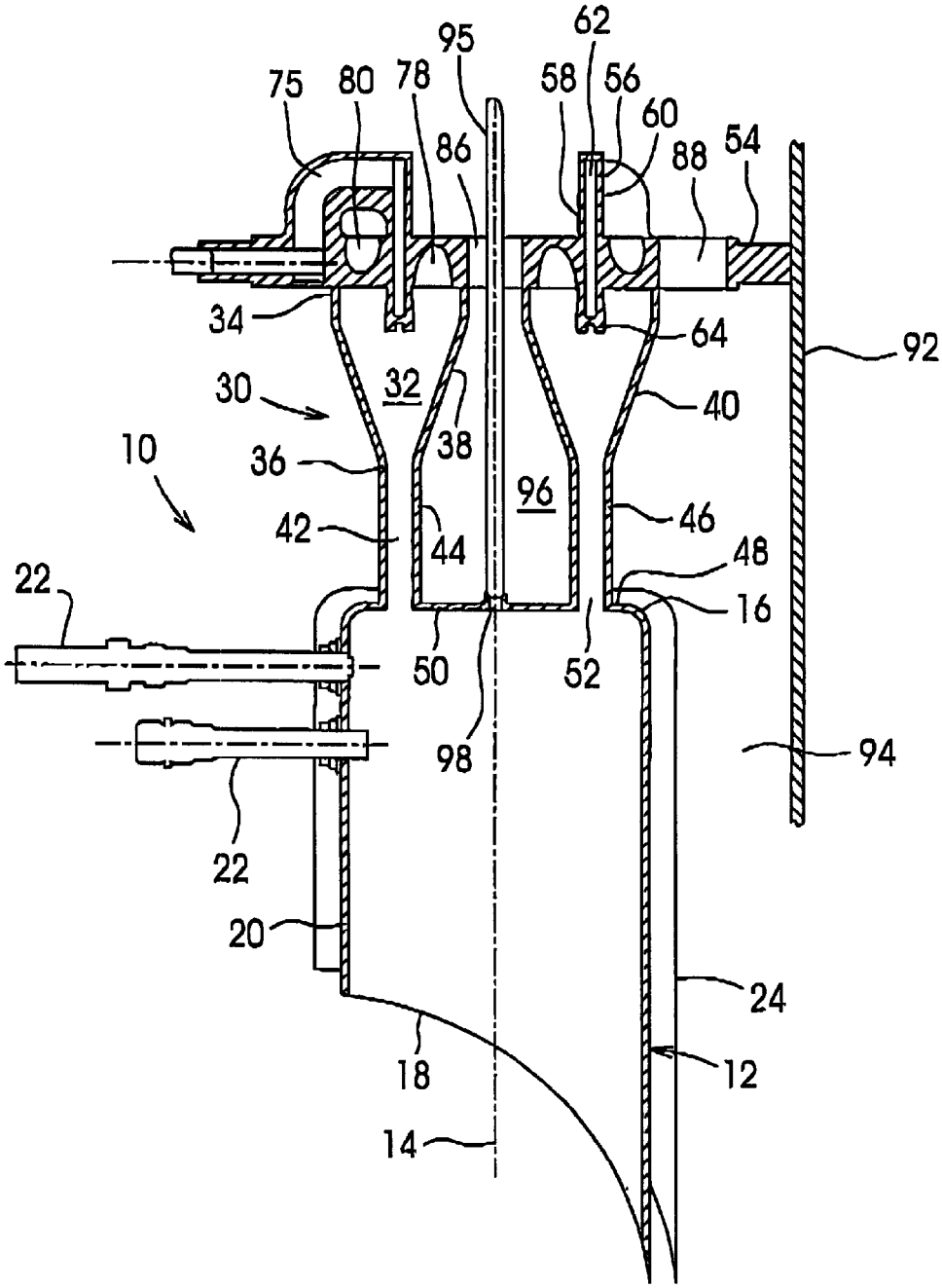
FIG. 1 is a cross-sectional view of a swirled diffusion dump combustor according to a preferred embodiment of the present invention.

A swirled diffusion dump combustor according to the present invention and indicated generally at numeral 10 is illustrated in FIG. 1. The combustor generally includes THE cylindrical combustor can 12 having a central axis 14, and an upstream end 16 and a downstream end 18 defined by an annular side wall 20. The combustor can 12 receives fuel and air mixture dumped therein through its upstream end 16 and produces combustion products which are discharged from the downstream end 18 into a combustion transition section (not shown . Two igniters 22 are attached to the side wall 20 of the combustor can 12 adjacent to the upstream end 16 thereof, and are exposed to the inside of the combustor can 12 for ignition of a fuel/air mixture in the combustor can 12 in order to start the combustion process. A circular impingement cooling skin 24 is provided around the combustor can 12 and is radially spaced apart from the side wall 20. The impingement cooling skin 24 includes a plurality of holes (not shown) for directing pressurized air flows to impinge upon the aide wall 20 of the combustor can 12 for cooling same, which is well known in prior art and therefore will not be further described.

The combustor 10 further includes a mixer 30 attached coaxially to the combustor can at the upstream end 16 thereof. The mixer 30 includes an annular chamber 32 which has an upstream end 34 and a downstream end 36 and includes an annular inner wall 38 and an annular outer wall 40. The annular inner wall 38 extends downstream-wise radially and outwardly while the annular outer wall 40 extends downstream-wise radially and inwardly to form a circumferentially continuous truncated-conical cross-section. A downstream annular passage 42 is provided in fluid communication with the annular chamber 32 and the combustor can 12. The downstream annular passage 42 is defined between cylindrical inner and outer walls 44 and 46 which extend between the downstream end of the annular chamber 32 and the upstream end 16 of the combustor can 12. The length of the passage is defined by the residence time of the premixer, to ensure this time is substantially lower than the auto ignition delay time of fuel/air mixture. In this particular embodiment of the present invention the outer wall 46 is an integral extension of the outer wall 40 of the annular chamber 32 and is secured to an annular outer portion 48 of the end wall of the upstream end 16 of the combustor can 12. The inner wall 44 is an integral extension of the inner wall 38 of the annular chamber 32 and includes an and plate 50 attached to the end periphery of the inner wall 44 forming a central portion of the end wall of the upstream end 16 of the combustor can 12. An annular opening 52 therefore, is defined at the upstream end 16 around the central portion 50 of the upstream end wall of the combustor can 12 to permit a swirled fuel/air mixture, which will be further described hereinafter, to be dumped into the combustor can 12 without interference.

The mixer 30 includes a manifold ring 54 which closes the upstream end 34 of the annular chamber 32. The manifold ring 54 includes a fuel ring 56, which is integrated with the manifold ring 54 in this embodiment of the present invention. The fuel ring 56 has annular inner and outer walls 58 and 60, respectively extending both upstream wise and downstream-wise from the manifold ring 54, thereby defining an annular fuel passage 62. The fuel ring 56 has an enlarged downstream end section 64 in which the inner wall 58 of the fuel ring 56 extends downstream-wise, radially and inwardly while the outer wall 60 extends downstream-wise radially and outwardly, as more clearly shown in FIG. 4.

Figure 4:
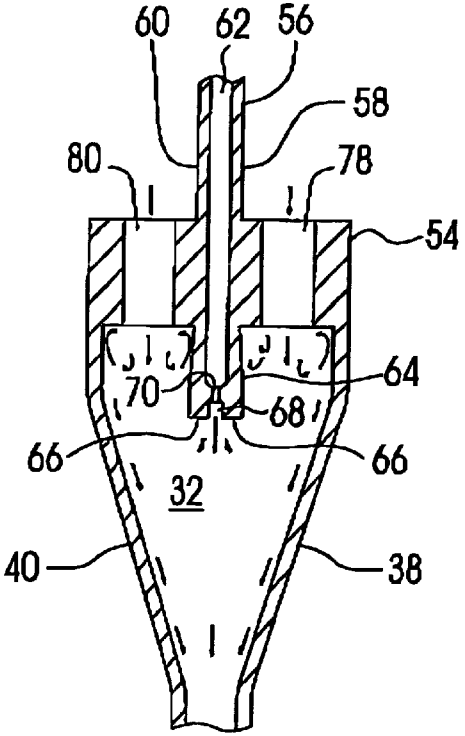
FIG. 4 is a partial schematical cross-sectional view of FIG. 1, showing the mixing action of fuel and air in the annular chamber of the mixer, particularly the axial re-circulation.

As illustrated in FIG. 4, an annular recess 68 is provided at the enlarged downstream end section 64 of the fuel ring 56, thereby forming a pair of annular lips 66 at the downstream end of the fuel ring 56. A plurality of small hales 70 is provided in the bottom of the annular recess 68 in a circumferentially spaced apart relationship to provide a plurality of fuel passages 62 into the annular chamber 32. The small holes 70 are angled tangentially to uniformly distribute fuel into the annular recess 68 in preparation for optimal fuel/air mixing, and to minimize any pockets of combustible fuel/air mixture in the annular recess 68.

Figure 2:
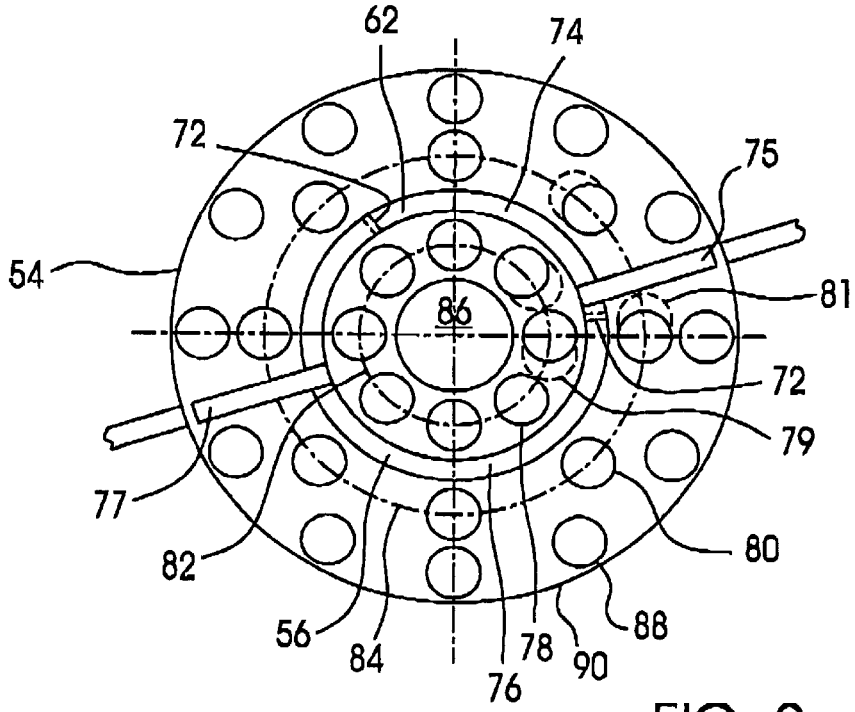
FIG. 2 is a top plan view of a manifold ring according to one embodiment of the present invention, and used in the embodiment of FIG. 1.

As shown in FIG. 2, two radially positioned baffle plates 72 are provided in the annular fuel passage 62 of the fuel ring 56, extending radially in a circumferentially spaced apart relationship to divide the annular fuel passage 62 into a first fuel passage section 74 and a second fuel passage section 76, permitting fuel delivery through either fuel passage section 74 or 76, or through both sections 74 and 76 simultaneously in order to achieve a fuel staging function. Two fuel pipes 75, 77 are provided respectively, connected to the respective first and second fuel passage sections 74 and 76 for independent fuel supply to the first and second fuel passage sections 74 and 76.

A first group of air passages 78 and a second group of air passages 80 are provided in the manifold ring 54 and extend therethrough. The air passages 78 and 80 of the two groups are distributed in a circumferentially spaced apart relationship along the respective first and second circular lines 82 and 84 which are coaxial with the fuel ring 56. Circular line 82 has a diameter smaller than the diameter of the fuel ring 56, the diameter of which is in turn smaller than the diameter of circular line 84 so that the annular fuel passage 62 is positioned between the two groups of air passages 78 and 84.

The air passages 78 and 80 are tangentially inclined in opposite rotational directions. In this embodiment of the present invention, the air passages 78 are inclined clockwise (only two of the passages 78 are shown with broken lines 79 indicating the inclined direction) and the passages 80 are inclined counter-clockwise (only two of the passages 80 are shown with broken lines 81 indicating the inclined direction).

Figure 3:
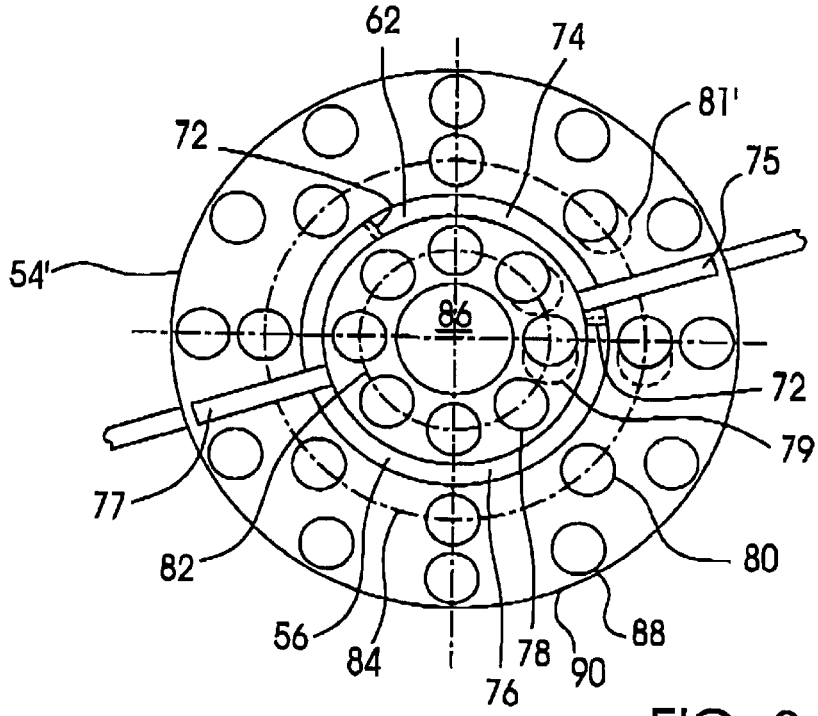
FIG. 3 is top plan view of a manifold ring in accordance with another embodiment of the present invention, alternatively used in the embodiment FIG. 1.

A manifold ring 54' according to another embodiment of the present invention of the present invention is shown in FIG. 3. The manifold ring 54' is similar to the embodiment 54 (illustrated in FIG. 2) and similar parts and features are indicated by similar numerals and will not, therefore be redundantly described. The only difference lies in that the air passages 78 and 80, in the two respective groups are tangentially inclined in one rotational direction, either clockwise or counter-clockwise. In this embodiment of the present invention, the air passages 80 are tangentially inclined clockwise (two of them are shown with broken lines 81'), in the same direction as air passages 78 are tangentially inclined (as shown with broken line 79). The effect of changing tangential direction of the air passages will be further described hereinafter.

The manifold ring 54 defines a central aperture 86 and is provided with a plurality of peripheral openings 88 which are positioned adjacent to the periphery 90 (shown in FIG. 2) of the manifold ring 54. As shown in FIG. 1, the combustor 10 further includes a cylindrical housing 92 (only one section of a side wall of the cylindrical housing 92 is shown) to contain and support the combustor can 12 and the mixer 30 therein. The peripheral openings 88 are in fluid communication with an annulus 94 defined between the combustor can 12 and the cylindrical hauling 92. A pilot fuel line 95 is inserted into the central aperture 86 and extends through a central passage 96 defined within the annular inner walls 38 and 44 to be attached to the center of the central portion 50 of the upstream end wall of the combustor can 12. A central hole 98 is provide in the central portion 50 of the upstream end wall of the combustor can 12 to permit fuel to be injected from the pilot fuel line 95 for a pilot flame in the combustor can 12 of the upstream end 16 thereof. A plurality of small holes (not shown) are also provided in the central portion 50 of the upstream end wall of the combustor can 12 through which the central passage 96 is in fluid communication with the combustor can 12.

In operation, compressor air approaches the mixer 30 from above. As shown in FIG. 1, the air flows through swirled air passages which are formed by the two groups of air passages 78 and 80 in the manifold ring 54, producing swirled air flows in the annular chamber 32. The fuel which may be gaseous or liquid (gaseous fuel in this embodiment of the present invention), is fed through the fuel pipes 75 and 77 (only 75 is shown in FIG. 1) into the annular fuel passage 62, and is sheared from the lips 66 (as shown in FIG. 4) of the manifold ring 54 by the swirled compressor air. In this way, the air is mixed into the fuel, and therefore the momentum of the fuel injection is not important to the fuel and air mixing process. Thus, it is possible to have a system with relatively low fuel side pressure drop, if required. The air swirl increases the turbulence and thereby increases the mixing of the fuel and air. The number and size of the air passages 78 and 80 which should be designed to meet individual engine requirements, control the total air flow through the device by acting as a restrictor. The fuel/air mixture then flows downward through the annular downstream passage 42 which serves as the region of diffusive mixing, and also as a flame flashback restrictor. The fuel/air mixture flow then dumps into the combustor can 12, providing the final level of mixing, and burns in the primary combustion zone which is located in the upstream section of the combustor can 12. The burning fuel/air mixture is stabilized by the swirl generated by the swirled air passages 78 and 80, and the pressure gradient induced re-circulation to the upstream end 16 of the combustor can 12. The igniters 22 are placed to take advantage of the re-circulating fuel/air mixture in the primary zone of the combustor can 12.

The swirled air passages 78 and 80 of the manifold ring 54 which are tangentially inclined in opposite rotational directions, create more air turbulence in the annular chamber 32 which is better for the mixing of fuel and air. However, the burning fuel/air mixture in the primary zone of a combustor can 12 is less stablized by the swirl generated by the oppositely inclined swirled passages 78 and 80.

In contrast, the manifold ring 54' shown in FIG. 3 has swirled air passages 78 and 80 tangentially inclined in one direction so that the burning fuel/air mixture in the primary zone of the combustor can 12 is stabilized by a stronger swirl generated by the swirled air passages. However, in this embodiment of the present invention, the air turbulence produced by the swirled air passages in the annular chamber 32 is somewhat reduced, which results in a compromised fuel and air mixing action.

In FIG. 4, arrows are used to show flow directions in the annular chamber 32. The tangential orientation of air passages 78, 80 and flow circulation in the circumferential direction are not shown. The truncated conical cross section defined by the annular inner and outer walls 38, 40 accelerates the flow downstream of the annular fuel passage 62, to increase the velocity of the fuel/air mixture flow, thereby preventing flame flashback and auto-ignition. Furthermore, the enlarged downstream end section 64, in cooperation with the truncated conical cross-section of the annular chamber 32 restricts axial flow re-circulation which is generated immediately downstream of the air passages 78, 80 toward an area generally upstream of the lips 66 of the fuel ring 56. Thus, very little fuel is involved in the axial flow re-circulation, which effectively inhibits auto-ignition.

As shown in FIG. 2, the fuel passage section 74 and fuel passage section 76 are connected to the respective fuel pipe 78 and 77 which controllably feed fuel to the respective fuel passage sections 74, 76 so that the fuel passage section 74 acts as a stage one fuel passage and the fuel passage section 76 acts as a stage two fuel passage. When about ⅓ of the total fuel flow mass is fed into fuel passage section 74 while the remaining portion of the fuel flow mass is fed into fuel passage section 76, the fuel flows are evenly distributed along the annular lips 66 of the fuel ring 56 (see FIG. 1) to ensure that an even and relatively lean fuel/air mixture is produced in the annular chamber 32 for normal engine operation. When a richer fuel/air mixture is required for a special operating condition and low emissions are not of concern, the total fuel flow mass can be shifted into the fuel passage section 74 which distributes the fuel slang about one third of the circumferential length of the annular lips 66 of the fuel ring 56. Thus, only a portion of the total air flow mass entering the annular chamber 32 is mixed with the fuel, and the remaining portion of the air flow mass is usable to actively participate in the mixing action within the annular chamber 32, such that a richer fuel/air mixture is produced.

As shown in FIG. 1, compressor air approaching the mixer 30 from above, will also flow through the central aperture 86 and the peripheral openings 88. The compressor air entering the central aperture 86 will pass through the central passage 96 and enter the combustor can 22 through a series of effusion holes
portion 50 of the upstream end wall of the combustor can 12, to cool the upstream end 16 of the combustor can 12. The compressor air entering the peripheral openings 88 fills the annulus 94 between the combustor can 12 and the cylindrical housing 92, and flows through the holes (not shown) in the impingement cooling skin 24 to cool the side wall 20 of the combustor can 12.

Figure 5:
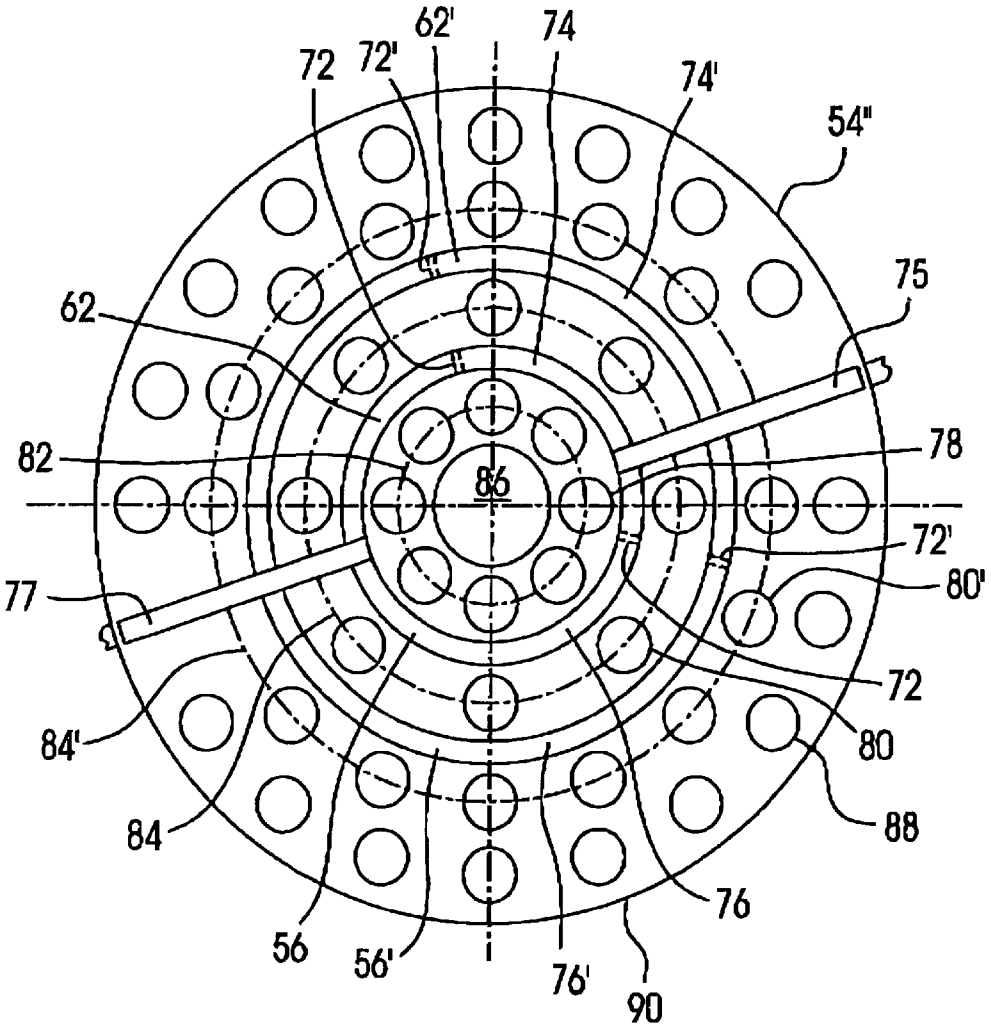
FIG. 5 is a top plan view of a manifold ring according to a further embodiment of the present invention.

In FIG. 5 a manifold ring 54" is illustrated according to another embodiment of the present invention. The manifold ring 54" has similar configurations and features as the manifold ring 54 of FIG. 2 which are indicated by similar numerals and will not therefore be redundantly described. The manifold ring 54" includes an additional fuel ring 56' and a third group of swirled air passages 80'. The additional fuel ring 56' is similar to the fuel ring 56 having an annular fuel passage 62' which is divided by two baffle plates 72' into two fuel passage sections 74' and 76', corresponding to the fuel passage sections 74 and 76 of the annular fuel passage 62 of the fuel ring 56. The fuel passage sections 74', 76' are also connected to the respective fuel pipes 75, 77 in fluid communication therewith to act together with the respective fuel passage sections 74, 76 as stage one and stage two fuel passages, respectively. The additional fuel ring 56' has a diameter greater thaw the diameter of the circular line 84 and the remaining configuration is similar to the fuel ring 56 as shown in FIGS. 1 and 4, and therefore, will not be redundantly described. The third group of swirled air passages 80' are distributed along a third circular line 84' in a circumferentially spaced apart relationship. The circular line 84' has a diameter greater than the diameter of the additional fuel ring 56'. The swirled air passages 80', 80 and 78 can be tangentially inclined in a same rotational direction or different rotational directions, similar to those described in FIGS. 2 and 3. FIG. 5 does not illustrate the direction of the tangential inclination of the swirled air passages 80', 80 and 78. A mixer of the present invention with the manifold ring 54" will work under the same principles as the mixer 30 shown in FIG. 1 and will provide an even better mixing of fuel and air.

Modifications and improvements to the above-described embodiment of the present invention may become apparent to those skilled in the art. The foregoing description is intended to be exemplary rather than limiting. The scope of the invention is therefore intended to be limited solely by the scope of the appended claims.

We claim:

1. A mixer for a gas turbine combustor comprising:

an annular chamber having an upstream end and a downstream end and including an annular inner wall and an annular outer wall to define the chamber, the annular inner wall extending downstream-wise, radially and outwardly, and the annular outer wall extending downstream-wise, radially and inwardly;

a manifold ring closing the upstream end of the annular chamber, the manifold ring including a fuel passage in fluid communication with the annular chamber for feeding fuel into the annular chamber and a plurality of swirled air passages to provide swirled compressor air flows into the annular chamber, the swirled air flows mixing with fuel from the fuel passages, thereby producing a fuel/air mixture in the annular chamber; and a downstream end of the annular chamber being adapted to be connected to the combustor in fluid communication therewith for dumping the fuel/air mixture into the combustor for combustion.

2. A mixer as claimed in claim 1 wherein the fuel passage is formed by a first fuel ring coaxial with the annular chamber, the first fuel ring including an annular fuel passage with a plurality of holes in a downstream end of the first fuel ring, the holes being located in a circumferentially spaced apart relationship.

3. A mixer as claimed in claim 2 wherein the first fuel ring comprises annular inner and outer walls extending from the manifold ring downstream-wise so that the holes is the downstream end thereof are located downstream of outlets of the swirled air passages in the manifold ring.

4. A mixer as claimed in claim 3 wherein the first fuel ring comprises a downstream end section, the inner wall of the downstream and section extending downstream-wise, radially and inwardly, and the outer wall of the downstream end section extending downstream-wise, radially and outwardly.

5. A mixer as claimed in claim 4 wherein the downstream end of the first fuel ring comprises an annular recess defining a pair of annular lips between the outer wall of the first fuel ring and the recess, and between the recess and the inner wall of the first fuel ring, the holes being positioned in a bottom of the annular recess such that the swirled air flow shears fuel from the lips of the first fuel ring to produce the fuel/air mixture.

6. A mixer as claimed in claim 5 wherein the holes in the bottom of the annular recess are tangentially angled to uniformly distribute fuel in the annular recess and minimize pockets of combustible fuel/air mixture in the annular recess.

7. A mixer as claimed in claim 2 wherein the annular fuel passage of the first fuel ring comprises two radially positioned baffle plates circumferentially spaced apart from each other to divide the annular fuel passage into first and second fuel passage sections, permitting fuel delivery through either fuel passage sections or through both sections simultaneously.

8. A mixer as claimed in claim 2 wherein the swirled air passages comprise first and second groups of air passages extending through the manifold ring and distributed in a circumferentially spaced apart relationship along respective first and second circular lines coaxial with the first fuel ring, the first circular line having a diameter smaller than a diameter of the first fuel ring, and the second circular line having a diameter greater than the diameter of the first fuel ring.

9. A mixer as claimed in claim 8 wherein the air passages is the respective first and second groups are tangentially inclined in one rotational direction, either clockwise or counter-clockwise to produce a spinal air flow in the annular chamber.

10. A mixer as claimed in claim 5 wherein the air passages in one of the first and second groups are tangentially inclined in a clockwise direction, while the air passages of the other group are inclined in a counter-clockwise direction to produce air turbulence in the angular chamber.

11. A mixer as claimed in claim 1 further comprising a downstream annular passage having cylindrical inner and outer walls extending downstream-wise from the downstream end of the annular chamber, the downstream annular passage serving as a region of diffusive mixing wind being adapted to be connected to the combustor in fluid communication, for dumping the fuel/air mixture from the annular chamber into the combustor for combustion.

12. A mixer as claimed in claim 8 wherein the manifold ring further comprises a second fuel ring similar to the first fuel ring, and a third group of air passages extending through the manifold ring and being distributed in a circumferentially spaced apart relationship along a third circular line coaxial with the first and second fuel rings, the second fuel ring having a diameter greater than the diameter of the second circular line, and the third circular line having a diameter greater than the diameter of the second fuel ring, the air passages of the respective first, second and third groups being tangentially inclined either in one rotational direction or in different rotational directions.

13. A gas turbine combustor comprising:

a cylindrical combustor can for receiving a fuel/air mixture to produce combustion products, the combustor can having a central axis and including an annular side wall and opposed upstream and downstream ends;

at least one igniter positioned inside the combustor can and attached to the combustor can; and a mixer for producing the fuel/air mixture, having a central axis thereof, coaxial with the combustor can, the mixer including:

an annular chamber having an upstream end and a downstream end and including an annular inner wall and an annular outer wall to define the chamber, the annular inner wall extending downstream-wise, radially and outwardly and the annular outer wall extending downstream-wise, radially and inwardly;

a manifold ring closing the upstream end of the annular chamber, the manifold ring including a fuel ring having annular inner and outer walls extending downstream-wise from the manifold ring, thereby defining an annular final passage therebetween, the annular fuel passage being in fluid communication with the annular chamber through a plurality of holes in a downstream end of the fuel rang, and the manifold ring further including a plurality of air passages extending through the manifold ring and tagentially inclined to provide swirled compressor air flows into the annular chamber, the swirled air flows mixing with fuel from the annular fuel passage, thereby producing the fuel/air mixture in the annular chamber; and a downstream end of the annular chamber being connected to the upstream end of the combustor can in fluid communication therewith, for dumping the fuel/air mixture into the combustor can for combustion.

14. A gas turbine combustor as claimed in claim 13 wherein the mixer comprises a downstream annular passage defined between cylindrical, inner and outer walls extending between the downstream end of the annular chamber and the upstream end of the combustor can an end plate attached to an end periphery of the inner wall forming a central portion of an upstream end wall of the combustor can, the downstream annular passage being in fluid communication with the combustor can through an annular opening at the upstream end of the combustor can around the central portion of the upstream end wall thereof.

15. A gas turbine combustor as claimed in claim 13 wherein the air passages in the manifold ring are distributed in a circumferentially spaced apart relationship along respective first and second circular lines coaxial with the fuel ring, the first circular line having a diameter smaller than a diameter of the fuel ring, and the second circular line having a diameter greater than the diameter of the fuel ring.

16. A gas turbine combustor as claimed in claim 15 wherein the downstream end of the fuel ring comprises an annular recess to form a pair of annular lips, the holes being positioned in an bottom of the annular recess such that the swirled air flows shear the fuel from the lips of the fuel ring to produce the fuel/air mixture.

17. A gas turbine combustor as claimed in claim 15 wherein the fuel ring comprises two radially positioned baffle plates circumferentially spaced apart from each other to divide the annular passage into first and second passage sections, permitting duel delivery through either passage section, or through both sections simultaneously.

18. A gas turbine combustor as claimed in claim 14 wherein the fuel ring comprises a central aperture in fluid communication with a central passage defined within the annular inner wall of the annular chamber for receiving a pilot fuel line extending therethrough and connected to the central portion of the upstream end wall of the combustor can for delivering fuel into the combustor can, the central portion of the upstream end wall including a plurality of holes for admission of air flows from the central aperture and the central passage to cool the upstream end wall of the combustor can.

19. A gas turbine combustor as claimed in claim 15 further comprising a cylindrical housing containing the combustor can, and defining an annulus between the combustor can and the housing, a plurality of peripheral openings in the manifold ring adjacent to the periphery of the manifold ring, the peripheral openings being in fluid communication with the annulus such that compressor air flows are introduced through the peripheral openings into the annulus to cool the side wall of the combustor can.

20. A gas turbine combustor as claimed in claim 19 wherein the combustor can further comprises an impingement cooling skin with a plurality of holes therein, the skin being positioned around the side wall of the combustor can in a radially spaced relationship.

* * * * *

UNITED STATES PATENT AND TRADEMARK OFFICE

CERTIFICATE OF CORRECTION

PATENT NO. : 6,530,222 B2
DATED : March 11, 2003
INVENTOR(S) : Peter Stuttaford and Aleksandar Kojovic It is certified that error appears in the above-identified patent and that said Letters Patent is hereby corrected as shown below:

Column 8,
Line 58, delete “is” and insert -- in --
Line 63, delete “and” and insert -- end --

Column 9,
Line 31, delete “spinal” and insert -- spiral --
Line 37, delete “angular” and insert -- annular --
Line 42, delete “wind” and insert -- and --

Column 10,
Line 11, delete “final” and insert -- fuel --
Line 14, delete “rang” and insert -- ring --
Line 29, insert -- , -- between “can” and “an”
Line 53, delete “duel” and insert -- fuel --

Signed and Sealed this

Sixth Day of May, 2003

JAMES E. ROGAN
*Director of the United States Patent and Trademark Office*